United States Patent [19]

Kawano

[11] Patent Number: 4,819,606

[45] Date of Patent: Apr. 11, 1989

[54] FUEL INJECTION TIMING CONTROL APPARATUS OF DISTRIBUTOR INJECTION PUMP FOR USE IN A DIESEL ENGINE

[75] Inventor: Hiroto Kawano, Hiroshima, Japan

[73] Assignee: Mazda Motor Corporation, Hiroshima, Japan

[21] Appl. No.: 126,053

[22] Filed: Nov. 27, 1987

[30] Foreign Application Priority Data

Nov. 28, 1986 [JP] Japan ..... 61-281892

[51] Int. Cl.[4] ..... F02M 39/00

[52] U.S. Cl. ..... 123/502; 123/380

[58] Field of Search ..... 123/502, 449, 380, 495

[56] References Cited

U.S. PATENT DOCUMENTS

| | | | |
|---|---|---|---|
| 3,960,127 | 6/1976 | Uuaille | 123/380 |
| 4,334,514 | 6/1982 | Konrath | 123/502 |
| 4,397,285 | 8/1983 | O'Neill | 123/502 |
| 4,469,066 | 9/1984 | Yuzawa | 123/502 |
| 4,475,521 | 10/1984 | Greiner | 123/502 |
| 4,522,181 | 6/1985 | Greiner | 123/502 |

*Primary Examiner*—Carl Stuart Miller

*Attorney, Agent, or Firm*—Fleit, Jacobson, Cohn & Price

[57] ABSTRACT

A fuel injection apparatus for a distributor injection pump for use in a diesel engine. The apparatus has an injection timing advancing device which advances a fuel injection timing of the distributor injection pump at an advancing rate responsive to a change of engine loading. A timing control includes a variable pressure relief system for changing the amount of pressure relieved from a pump chamber of the distributor injection pump. This variable pressure relief system can change the advancing rate of the injection timing advancing device in such a way that the advancing rate becomes lower in a low range of engine loading than in a high range of engine loading. The advancing rate may be continuously increasingly varying from that determined by the low engine loading in accordance with atmospheric pressure to a mostly increased advancing rate which is higher than a predetermined advancing rate in the high range of engine loading.

14 Claims, 5 Drawing Sheets

ADVANCE
INJECTION NOZZLE

OVER FLOW
FUEL INLET

FUEL INJECTION TIMING CONTROL APPARATUS OF DISTRIBUTOR INJECTION PUMP FOR USE IN A DIESEL ENGINE

BACKGROUND OF THE INVENTION

The present invention relates to a fuel injection timing control apparatus of a distributor injection pump for a diesel engine.

As is well known in the diesel engine field, a distributor injection pump of a diesel engine is generally adapted to advance a fuel injection timing at which the distributor injection pump distributes fuel as a rise of revolution speed of the diesel engine. In order to decrease one of emissions, oxides of nitrogen (NOx), in the exhaust from the diesel engine driven in a low or a relatively low range of engine loading most frequently used, the distributor injection pump is provided with a so-called load-sensing timer as a fuel injection timing advancing device to operate the fuel injection pump at a retarded injection timing in the low or relatively low range of engine loading more later than in a high range of engine loading, simultaneously with dropping the burning temperature of fuel in the diesel engine by the aid of an exhaust gas recirculation device ( EGR ).

Meanwhile, when operating the diesel engine at high elevations, for example higher than approximately an altitude of 1,600 m, but depending on diesel engines, where the air becomes thinner and atmospheric pressure drops, compressed air pressure tends to become lower due to a lowered density of the air, leading to a deterioration of the inflammability of fuel. Therefore, when operating in the low or relatively low range of engine loading at high elevations, the diesel engine often causes what may be called misfiring or incomplete firing due to the deterioration of the inflammability of fuel caused by the dropped compressed air pressure and the exhaust gas recirculation, in addition to the retarded fuel injection timing of the distributor injection pump by the so-called load-sensing timer, resulting in a decline of engine power which not only lowers a performance of the diesel engine operation but also makes the diesel engine produce emissions including white smoke. Moreover, the diesel engine, which essentially tends to emit smoke ( black smoke ) in the high range of engine loading at high elevations, exhausts still more smoke due to the fact that the fuel mixture tends to become overly rich in that the air becomes thinner and contains less oxygen to sustain burning.

In an attempt at overcoming this problem of the prior art distributor injection pumps, an improved fuel injection timing control device has been proposed in, for example, Japanese Utility Model Publication No. 60-8,129 issued on Mar. 20, 1985, entitled "Distributor Injection Pump". In this distributor injection pump, a fuel injection timing control device is adapted substantially to advance a fuel injection timing of the distributor injection pump by suspending the load-sensing timer in the low or relatively low range of engine loading at high elevations where atmospheric pressure drops lower than a pressure predetermined in association with the diesel engine.

One disadvantage associated with such distributor injection pump of the type which has the load-sensing timer suspended when operating in the low or relatively low range of engine loading at high elevations is that, because the distributor injection pump distributes fuel at fuel injection timing advanced depending only on a rotation speed of the diesel engine but is not compensated in accordance with engine loading, it is a bit difficult to eliminate the occurrence of misfiring or incomplete firing in the low or relatively low range of engine loading and to eliminate or control smoke emitted on burning in the high range of engine loading; the performance of diesel engine operation is possibly lowered and emission control is still difficult.

One approach to overcoming drawbacks associated with such a distributor injection pump has become known from Japanese Utility Model Unexamined Publication No. 59-157,549 laid open Oct. 23, 1984, entitled "Fuel Injection Pump" disclosed by the same applicant of this application, in which a fuel injection timing of the fuel injection pump is, when operating at high elevations where atmospheric pressure drops, advanced in the low or relatively low range of engine loading and, on the other hand, retarded in the high range of engine loading later than in the low or relatively low range of engine loading. For accomplishing this, a fuel injection timing control apparatus cooperates with a specific load-sensing timer which is so constructed as to reverse the relationship between an advance-retardation characteristic of fuel injection timing and the range of engine loading between the high and the low or relatively low elevations.

OBJECT OF THE INVENTION

It is an object of the present invention to provide a fuel injection timing control apparatus of a distributor injection pump for use in a diesel engine which will more precisely control fuel injection timing according to altitudes.

It is another object of the present invention to provide a fuel injection timing control apparatus of a distributor injection pump of use in a diesel engine which can continuously vary a fuel injection timing earlier or later depending on altitudes when operating in a low or relatively low range of engine loading.

SUMMARY OF THE INVENTION

In accordance with the present invention, the fuel injection timing control apparatus includes fuel injection timing advancing means for advancing a fuel injection timing of a distributor injection pump of a diesel engine depending on engine loading; retarding means which is adapted substantially to retard the fuel injection timing in a low range or relatively low range of engine loading ( which is hereinafter referred as to a low range of engine loading for simplicity ) by dimminishing an advancing rate of the fuel injection timing advancing means lower than a predetermined advancing rate in a high range of engine loading; advancing rate varying means for, in the low range of engine loading, continuously increasingly or decreasingly varying the advancing rate of the fuel injection timing advancing means between the mostly dimminished advancing rate and a certain advancing rate higher than the predetermined advancing rate; and means responsive to atmospheric pressure for forcing the advancing rate varying means to make the fuel injection timing advancing means effect the continuously increasing or decreasing variation of advancing rate depending on atmospheric pressure.

It is a feature of the present invention that the fuel injection pump can vary continuously its fuel injection timing properly as altitudes when operating in the low range of engine loading. According to this feature of altitude compensating fuel injection timing, the diesel engine incorporating the injection timing control apparatus of this invention can operate with an highly improved emission efficiency at high elevations without any deterioration of emission efficiency at low elevations and be prevented from surging due to misfiring or incomplete firing which will frequently occur in the low range of engine loading and from emitting smoke when operating in the high range of engine loading at high elevations. Moreover, no knockings occur all over drivable altitudes, resulting in a quiet engine operation and the prevention of erosion of elements associated with the diesel engine.

The above and other objects and features of the present invention will become apparent from the following description of preferred embodiments taking reference to the accompanying drawings.

DETAILED DESCRIPTION OF THE INVENTION

Because fuel injection pumps for diesel engines are well known, the present description will be directed in particular to elements forming part of, or cooperation directly with, apparatus in accordance with the present invention. It is to be understood that elements not specifically shown or described can take various forms well known to those skilled in the fuel injection pump art.

In the following description, the term "advanced fuel injection timing" as used herein shall mean and refer to a fuel injection timing earlier than a predetermined fuel injection timing of the fuel injection pump when the diesel engine is operated in a high range of engine loading at low elevations and the term "retarded fuel injection timing" as used herein shall mean and refer to a fuel injection timing of the fuel injection pump later than said predetermined fuel injection timing. Furthermore, the term "predetermined advancing rate" as used herein shall mean and refer to a predetermined or preselected constant rate at which fuel injection timing is advanced to adjust the precombustion rate of fuel mixture so as to prevent diesel knocking and smoke in a high range of engine loading regardless of the change of atmospheric pressure.

Figures 1, 2:
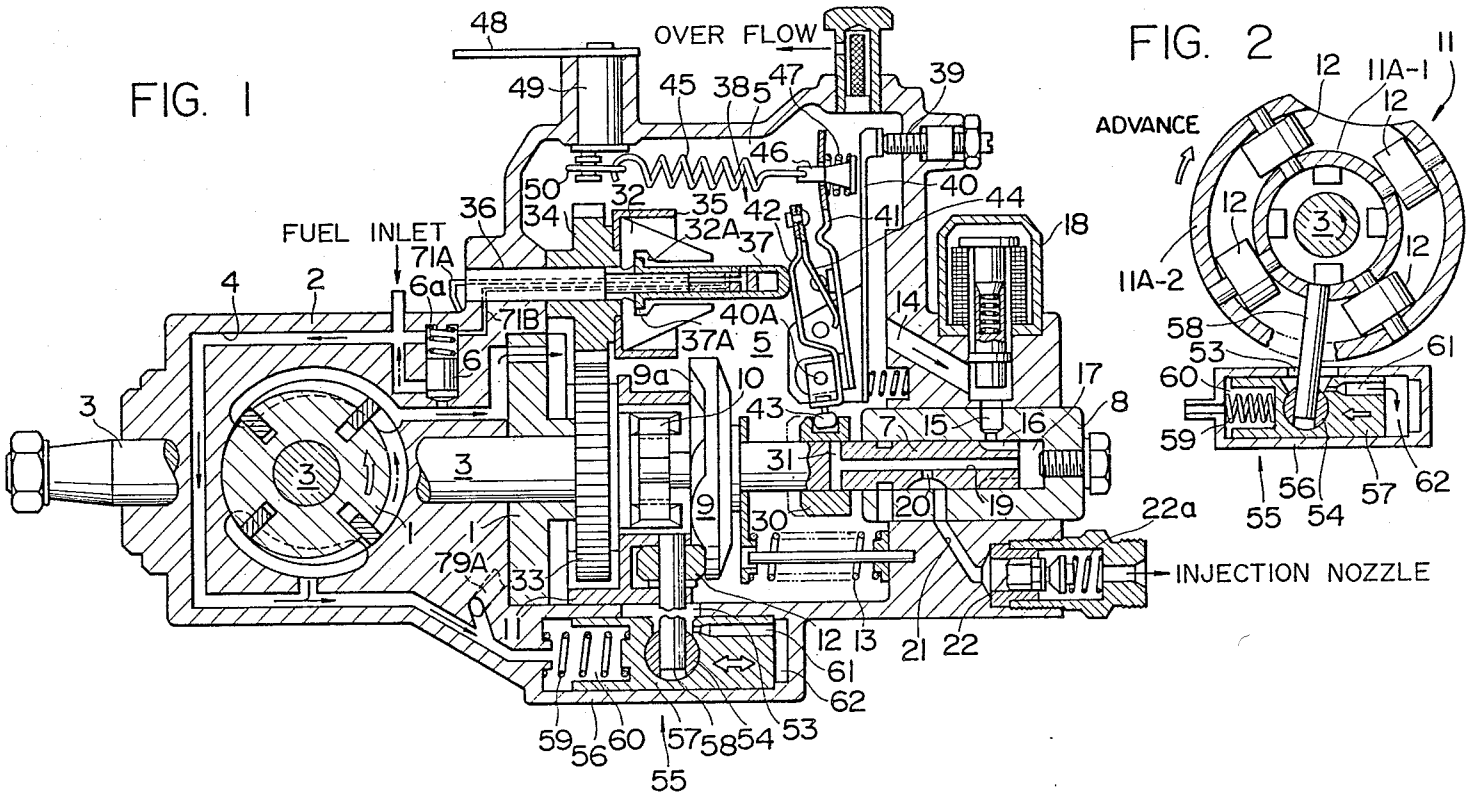
FIG. 1 is a transverse sectional view, partly in cross section, of a fuel injection pump in accordance with the present invention.
FIG. 2 is a cross sectional view of a speed timer of the fuel injection pump of FIG. 1.

Referring now to the drawings, wherein like reference characters designate corresponding parts or elements throughout the several views, FIG. 1 shows a distributor injection pump of a diesel engine ( not shown ) having a housing 2 in which a vane type fuel feed pump 1 ( which is depicted as turned through 90 for easy understanding and overlapped on the transverse cross sectional view of the fuel injection pump ). This feed pump 1 is synchronized with the diesel engine through a drive shaft 3 for rotation so as to feed fuel under pressure into a pump chamber 5 of the fuel injection pump from a fuel inlet conduit 4. As is well known to those skilled in the art, due to this synchronized rotation of the fuel feed pump 1, the internal pressure of the pump chamber 5 rises with an increase of revolution speed of the drive shaft 3, namely the diesel engine. Part of fuel fed by the fuel feed pump 1 returns into the fuel inlet conduit 4 through a regulating valve 6 so as to regulate an internal pressure in the pump chamber 5 by the force of a spring 6A of the regulating valve 6 in order to let the internal pressure in the pump chamber 5 depend on the feeding rate of the fuel feed pump 1, namely the revolution speed of the diesel engine. Shown at 7 is a pumping and distributing plunger ( hereinafter referred to as a pump plunger ) which is slidably supported in a plunger head cylinder 8 incorporated in the housing 2 for rotational movement. Fixedly attached to one end of the pump plunger 7 is a surface cam disk 9 having cam lobes 9A as many as the number of combustion cylinders of the diesel engine. The cam disk 9 is coupled to the drive shaft 3 by means of a cross coupling member 10 for rotational and axial movement.

In the housing 2 there is a so-called speed-sensing timer assembly for controlling the pump plunger 7 to vary its fuel injection timing which generally comprises a roller assembly 11 disposed and supported inside a generally cylindrical wall (not shown) formed in the housing 2 for rotation and an fuel injection timing advancing device 55 of which the function and construction will be described in detail later. It should be noted in FIG. 1 that the fuel injection timing advancing device 55 is depicted as turned through 90° for easy understanding. However, the fuel injection timing advancing device 55 is actually incorporated in such a way to turn the roller assembly 11 about the drive shaft 3. As is shown in detail in FIG. 2, this roller assembly 11 includes a cylindrical double-walled roller holder 11A having an inner wall 11A-I and a partially cutaway outer wall 11A-2, and rollers 12 as many as the number of the cam lobes 9A of the surface cam disk 9 which are supported between the inner and outer walls 11A-1 and 11A-2 of the double-walled roller holder 11 for rotation. The roller holder 11 is disposed coaxially with and rotatable with respect to both of the drive shaft 3 and the surface cam disk 9. The pump plunger 7, and hence the surface cam disk 9, is forced to move to the left as viewed in FIG. 1 by means of a plunger return coil spring 13 so as always to bring the cam surface of the surface cam disk 9 into contact with the roller 12.

Through this contact rotation of the surface cam disk 9 with respect to the roller 12, the pump plunger 7 can make a reciprocating motion for its fuel intake and feed stroke under pressure and a rotating motion synchronized with a rotation of the driving shfat 3, and hence the fuel feed pump 1, for its fuel distribution operation, simultaneously. Therefore, while the pump plunger 7 is in its intake stroke, namely rotates and moves to the left as viewed in FIG. 1, fuel in the pump chamber 5 is forced to flow into one of a plurality of longitudinal inlet grooves 16 formed on an outer periphery of a plunger head portion of the pump plunger 7 at regular intervals through an angled inlet passage 14 formed in the housing 2 and an inlet port 15 formed in the plunger head cylinder 8, and then into a pressure chamber 17 formed between a head of the pump plunger 7 and an inner wall of the plunger head cylinder 8. Disposed between the angled inlet passage 14 and the inlet port 15 is a fuel cut solenoid valve 18 of which the structure and function is well known to those skilled in the art, so that a more detailed description is unnecessary.

On the other hand, when the pump plunger 7 is in its compression and discharge stroke, namely axially moves to the right as viewed in FIG. 1, the head of the pump plunger 7 brings the angled inlet passage 14 out of communication with any one of the longitudinal inlet grooves 16 to cut off fuel flow any more into the pressure chamber 17 and simultaneously compresses the fuel in the pressure chamber 17. Consequently, the compressed fuel is forced to flow through an axial passage 19 and a distribution port 20 in the form of a radial passage both of which are formed in the pump plunger 7. With the rotation of the pump plunger 7, the distribution port 20 is brought into communication with distribution passages 21 formed extending through the plunger head cylinder 8 and the housing 2 each of which communicates with a fuel delivery valve 22, one after another. For clarity, although only one of the fuel delivery valves 22 is shown in FIG. 1, it is to be understood that there are arranged such fuel delivery valves 22 as many as the number of combustion cylinders of the diesel engine, one individual to each combustion cylinder. The delivery valve 22 is provided with a compression coil spring **22*a* by which a valve opening pressure is regulated. Though not shown in FIG. 1, a fuel passed through the delivery valve 22** is sprayed into the combustion cylinder through an injection nozzle in a well known manner.

A spill ring 30 with an annular groove 30A formed on its outer periphery thereof is mounted on the pump plunger 7 for axial movement and is operated in cooperation with a so-called load sensing timer comprising a governor assembly 38 which will be described in detail later. As is well known, the spill ring 30 is controlled by the governor assembly 38 to move axially so as to open and close a plunger spill port 31 formed in the pump plunger 7 and in communication with the axial passage 19 in such a way to change the timing of spilling the fuel in the axial passage 19 of the pump plunger 7 into the pump chamber 5 and vary the amount of fuel to be spilled through the plunger spill port 31 into the pump chamber 5 of the fuel injection pump. Specifically, when the spill ring 30 moves to the left position shown by a double dotted line in FIG. 1, the plunger spill port 31 opens, allowing fuel in the passage 19 of the pump plunger 7 to spill into the pump chamber 5 and simultaneously stopping the flow of fuel from the distribution port 20 into the distribution passage 21 so as to terminate one cycle of fuel distribution.

Figure 3:
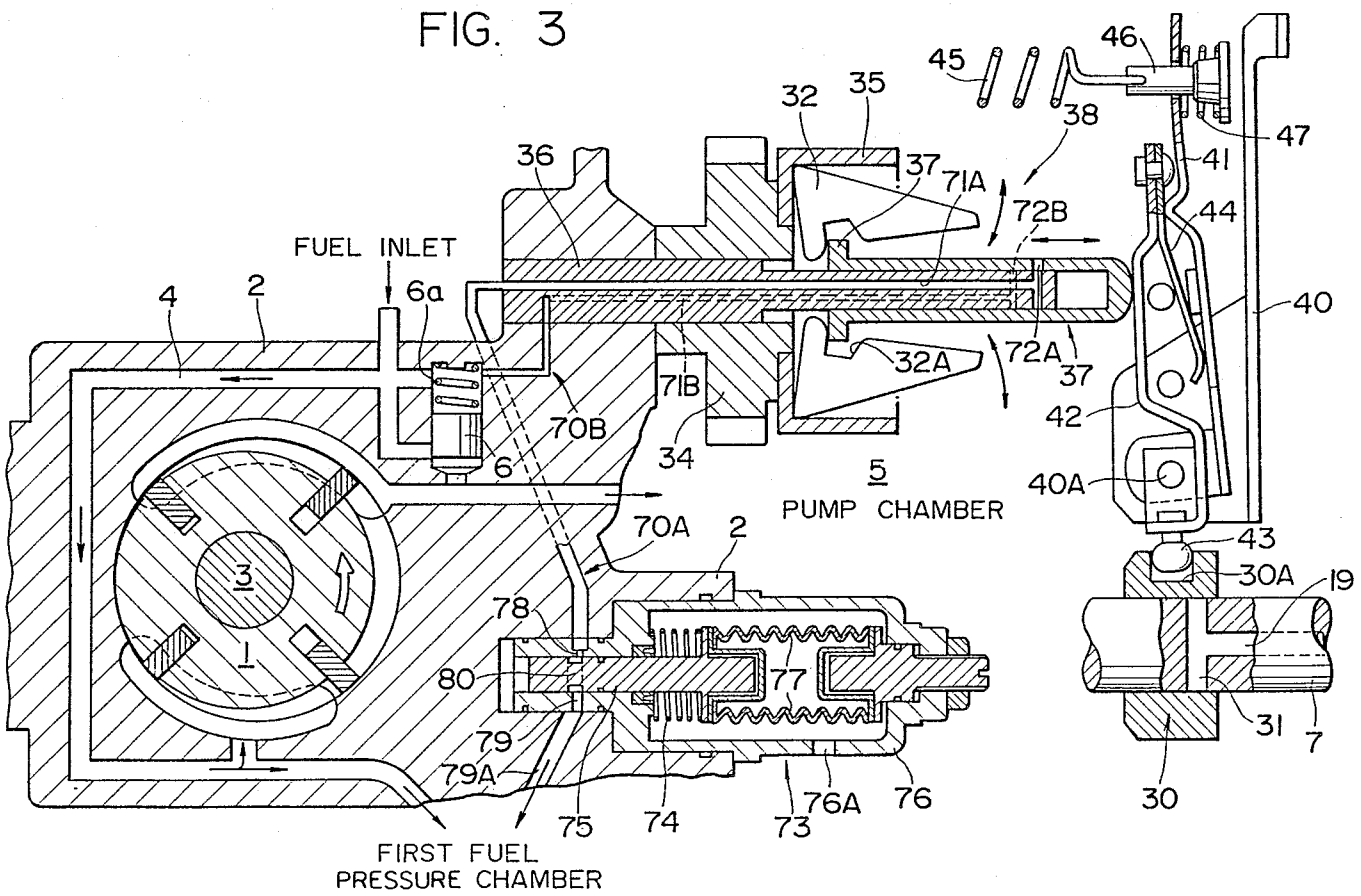
FIG. 3 is is a transversal sectional view of an essential part of the fuel injection pump of FIG. 1.

Reference is now had to FIG. 3, the governor assembly 38 is provided to function as a load-sensing timer for controlling the timing and quantity of fuel to be spilled according to engine loading. This governor assembly 38 includes a plurality, for example four pieces in this embodiment, of fly-weights 32 supported by a fly-weight holder 35 attached to a driven gear 34 which is in engagement with a driving gear 33 fixed to the driving shaft 3. As is well known, the driven gear 34 to which the fly-weight holder 35 is attached is supported by a governor shaft 36 for rotation through the engagement with the driving gear 33 attached to the drive shaft 3. Each fly-weight 32 having a generally triangular cross section is formed with an inner arcuate groove 32A which is engaged by a flange 37A of a closeended governor sleeve 37 mounted on and supported by the governor shaft 36 for axial movement. Each fly weight 32 is adapted to swing outwardly by a centrifugal force when it rotates about the governor shaft 36, so as to move the governor sleeve 37 in an axial direction toward the right.

The governor assembly 38 includes a lever assembly comprising a corrector lever 40 with its top end pressed by a full-load adjusting screw 39, a tension lever 41 and a start lever 42. Each end of the tension lever 41 and the start lever 42 is pivoted at its lower end by a pivot 40A on a lower portion of the corrector lever 40. The start lever 42 is provided at its distal end with a ball-head pin 43 which is in engagement with the inside of an arcuate groove 30A of the spill ring 30. Between the tension lever 41 and the start lever 42, there is a start spring 44 in the form of a leaf spring fixed to the start lever 42 at its top end.

The governor assembly 38, as is seen in FIG. 1, also includes a governor spring 45 with one end bearing against the tension lever 41 through a retaining member 46 and an idle spring 47 and the other end held by a shackle 50 eccentrically fixed to a rotatable shaft 49 of a control lever 48 operated in cooperation with an accelerator pedal ( not shown ). According to this governor assembly 38, the governor sleeve 37 receives at its top end a spring force of the governor spring 45 depending on an operated angle of the control lever 48 as well as spring forces of the idle spring 47 and the start spring 44. As a result, the governor sleeve 37 rests at a position where the centrifugal force caused by the rotation of the fly weights 32 and the total force of the spring assembly is well balanced. According to the rest position of the governor sleeve 37, the start lever 42 pivotally turns to shift axially the spill ring 30 with respect to the pump plunger 7, changing a timing at which the plunger spill port 31 opens to the pump chamber 5 so as to vary a distance by which the pump plunger 7 reciprocally moves during its inlet and compressing stroke in order to increase or decrease the quantity of fuel to be distributed into the combustion chamber of each cylinder of the diesel engine.

Turning to FIG. 1, for advancing and retarding the fuel injection timing of the fuel injection pump, there is the fuel injection timing advancing device 55 forming a part of the speedsensing timer, which is in cooperation with the roller assembly 11 as previously described. In cylinder 56 formed in the housing 2, a timer piston 57 is disposed in such a way to move in the opposite direction perpendicular to the axial direction of the drive shaft 3. As can be best seen in FIG. 2, in the timer piston 57 there is a ball 54 with a cylindrical bore 54A. A connecting rod 58 extending from the cylindrical double-walled roller holder 11 is slidably received so as to retractably protrude therefrom. On one side of the timer piston 57 in the cylinder 56 there is formed a first fuel pressure chamber 60 wherein a coil spring 59 is disposed and in which a pressure is established by the fuel applied from the inlet passage 4 of the feed pump 1. On the other side of the timer piston 57 in the cylinder 56 there is a second pressure chamber 62 wherein a pressure is applied by the fuel in the pump chamber 5 through an intake port 53 formed in the cylinder 56 and a fuel passage 61 formed in the timer piston 57. Because of a pressure difference occurring between the first and second pressure chambers 60 and 62, namely between the fuel pressure in the pump chamber 5 and a total pressure of the fuel pressure supplied from the inlet passage 4 and a spring force of the coil spring 59, the timer piston 57 changes its position in the cylinder 56, turning the roller holder assembly 11 in the cylindrical wall formed in the housing 2, so as to change the respective rollers 12 in angular position with respect to the surface cam disk 9, in particular the cam lobes 9A, through the connecting rod 58. As a result, the distribution injection pump advances its fuel injection timing in accordance with an increase of pressure of the fuel fed in the pump chamber 5, namely an increase of rotation speed of the diesel engine.

Referring again to FIG. 3, there are first and second pressure relief systems 70A and 70B for increasingly or decreasingly varying the advancing rate of of the fuel injection timing advancing device 55. The first relief system 70A comprises a fuel relief passage 71A having a relatively large cross sectional area which extends axially in the governor shaft 36 to a regulating valve 73 which communicates with the first fuel pressure chamber 60 of the fuel injection timing advancing device 55 through a conduite 79A communicating with the fuel inlet conduit 4, and opens at one end to an outer periphery of the governor shaft 36; first relief port 72A formed in the governor sleeve 37 by which the first fuel relief passage 71A and the pump chamber 5 are communicated upon an axial movement of the governor sleeve 37 to the rightmost position shown in FIG. 7(A) when the diesel engine operates in the low range of engine loading; and a regulating valve 73 of which the construction and function will be described in detail later, disposed in the first fuel relief passage 71A and disposed adjacent to the fuel injection timing advancing device 55, the regulating valve 73 functioning to regulate the quantity of fuel to be relieved through the first fuel relief passage 71A according to atmospheric pressure.

The second pressure relief system 70B comprises second fuel relief passage 71B having a relatively small cross sectional area which extends partly in the governor shaft 36 parallel with the first fuel relief conduit 71A and, at one end, communicating with the fuel inlet conduit 4 and opens at the other end to an outer periphery of the governor shaft 36; and second relief port 72B located at a distance apart left side from the first relief port 72A in the governor sleeve 37 by which the second fuel relief passage 71B and the pump chamber 5 are communicated upon an axial movement of the governor sleeve 37 to the right as viewed in FIG. 3 when operating in the high range of engine loading. The first fuel relief passage 71A is, as is apparent from the previous description, in communication with the first pressure chamber 60 of the timing advancing device 55 through the regulating valve 73 and, on the other hand, the second fuel relief passage 71B is directly communicated with the fuel inlet conduit 4 of the feed pump 1.

The regulating valve 73 disposed in the first pressure relief system 70A has a valve body 75 in the form of a piston slidably supported in a valve casing 76 for axial movement. This valve body 75 is connected at its one end to an aneroid in the form of a pressure sensitive sealed bellows 77 disposed in the casing 76 with a vent opening 76A formed therein by which the inside of the casing is communicated with the atmosphere. Between the aneroid 77 and the valve casing 76, there is a coil spring 74 for ordinarily urging the aneroid 77 to decrease its volume so as to open the first fuel relief passage 71A. The aneroid 77 increases its volume as atmospheric pressure drop, expanding against the coil spring 74 to move axially the valve body 75 to the left as viewed in FIG. 3.

Figure 4:
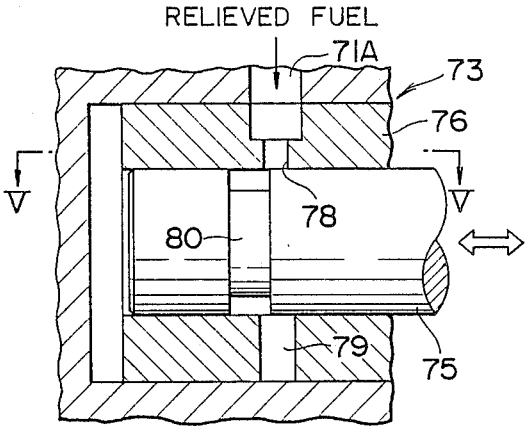
FIG. 4 is a cross sectional view of a regulating valve of a fuel relief system.
Figure 5:
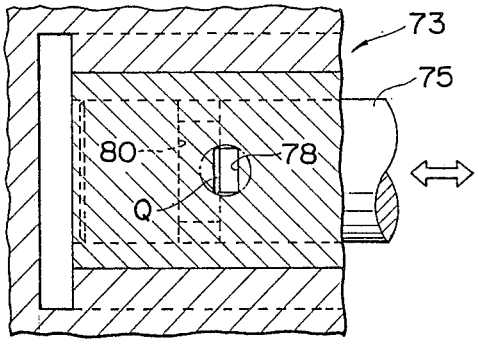
FIG. 5 is a transverse section taken generally along a line V—V of FIG. 4.
Figure 6:
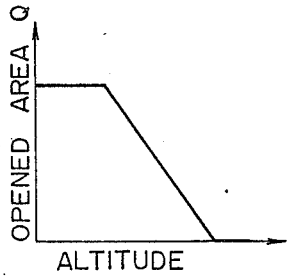
FIG. 6 is a diagram showing the relationship between opening and altitude of the regulating valve of FIGS. 4 and 5.

As is clearly shown in FIGS. 4 and 5, the casing 76 supporting the valve body 75 therein is formed with an inlet port 78 having a rectangular cross section which is in communication with the first fuel relief passage 71A and an outlet port 79 disposed diametrically opposite to the inlet port 78 which is in communication with the first pressure chamber 60 of the fuel injection timing advancing device 55 through the fuel inlet conduit 4. As best shown in FIG. 4, the valve body 75 is formed with an annular groove 80 on its outer periphery. By the aid of this annular groove 80 of the valve body 75, the inlet port 78 changes linearly its opened area Q as the valve body 75 moves axially according to changes of atmospheric pressure or altitudes at which the diesel engine is operated, resulting in a linear change of the quantity of fuel relieved through the first pressure relief system 70A as is shown in FIG. 6. On the other hand, the valve body 75 shuts completely the first pressure relief system 71A at a lower altitude.

In the above described structure, it is to be noted that the advancing rate varying means comprises the first and second fuel relief passages 71A and 71B formed partly in the governor shaft 36 and partly in the housing 2, the first and second ports 72A and 72B formed in the governor sleeve 37, the valve body 75, and the inlet and outlet ports 78 and 79 formed in the casing 76 of the regulating valve 73. On the other hand, the pressure sensitive means comprises the coil spring 74 disposed in the regulating valve 73, the the casing 76 formed with the vent opening 76A, and the aneroid 77 in the form of a bellows disposed in the casing 76 of the regulating valve 73.

Figure 7:
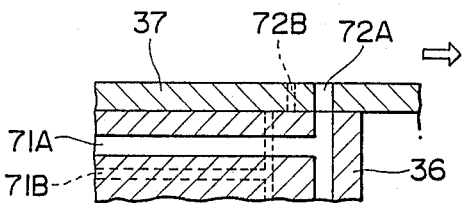
FIG. 7(A) and 7(B) are cross sectional views showing the essential part of a governor sleeve of a preferred embodiment of the present invention.
Figure 7:
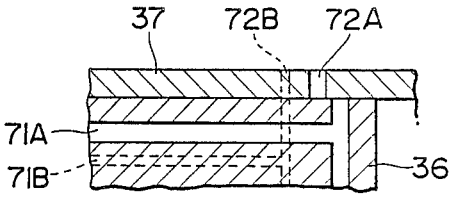

In operation of the fuel injection timing control apparatus according to the present invention, the governor sleeve 37 is placed in a position shown in FIG. 7(A) when operating in the low range of engine loading and in a position shown in FIG. 7(B) when operating in the high range of engine loading. On the other hand, the valve body 75 is placed in a position shown in FIG. 8(A) where the annular groove 80 communicates the inlet and outlet ports 78 and 79 formed in the casing 76 of the regulating valve 73 when operating at low elevations and in a position shown in FIG. 8(B) where annular groove 80 is placed out of alignment with the inlet and outlet ports 78 and 79 when operating at high elevations.

Figure 8:
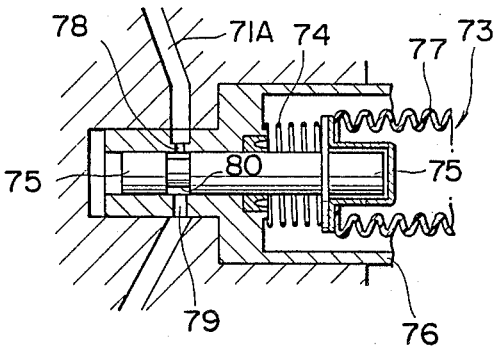
FIG. 8(A) and 8(B) are cross sectional views partially illustrating the regulating valve when operating at low elevations and at high elevations, respectively.
Figure 8:
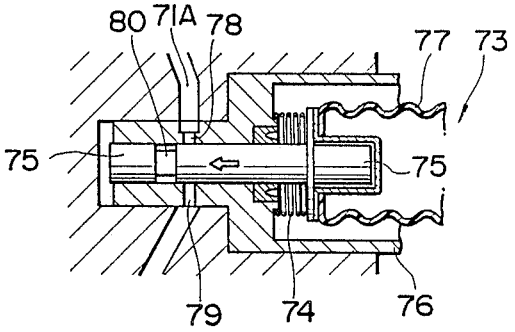
Figure 9:
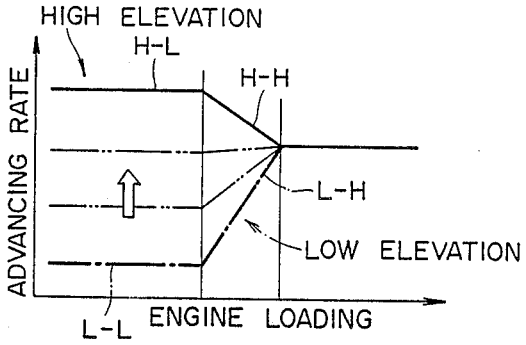
FIG. 9 is a diagram showing the relationship between advancing rate of fuel injection timing and engine load for several altitudes.

For various driving conditions, the respective elements of the fuel injection pump operate to vary fuel injection timing of the fuel injection pump as follows:

(1) Low Elevations, Low Engine Loading;

Because of a small quantity of fuel distributed by the fuel injection pump, the governor sleeve 37 protrudes to its extremity to the right as shown in FIG. 7(A), bringing the second relief port 72B out of communication with the second fuel relief passage 71B so as to disable operation of the second pressure relief system 70B, on the other hand, the first port 72A of the governor sleeve 37 into communication with the first fuel relief passage 71A of the governor shaft 36. Simultaneously, as is shown in FIG. 8(A), because of a low atmospheric pressure, the aneroid bellows 77 contracts, moving the valve body 75 of the regulating valve 73 axially to the right to its extremity so as to provide the maximum opened area Q in the inlet port 78 of the regulating valve 73. As a result, so as to relieve fuel pressure from the pump chamber 5 through the first pressure relief system 70A including the fuel relief passage 71A with a relatively large inner diameter into the first pressure chamber 60 of the timing advancing device 55. As a result, the pressure in the first pressure chamber 60 of the fuel injection timing advancing device 55 mostly rises, slowing down the movement of the timer piston 57 of the timing advancing device 55, and hence the angular movement of the roller holder assembly 11, thereby the fuel injection pump distributes fuel at the mostly retarded injection timing shown by reference characteristics L—L in FIG. 9. In other words, the advancing rate of fuel injection timing of the fuel injection pump becomes the lowest.

(2) Low Elevations, High Engine Loading;

Under this driving condition, because of a large quantity of fuel distributed by the fuel injection pump, the governor sleeve 37 moves by the slightest distance to the leftmost position as is shown in FIG. 7(B). Therefore, although the inlet port 78 of the regulating valve 73 is fully opened by the annular groove 80 of the valve body 7 as shown in FIG. 8(A) the first relief port 72A of the governor sleeve 37 is brought out of communication with the first fuel relief passage 71A, disabling the first pressure relief system 70A from operating. On the other hand, as is shown in FIG. 7(B), the second relief port 72B of the governor sleeve 37 is placed in communication with the second fuel relief passage 71B, thereby relieving the fuel pressure in the pump chamber 5 through the second pressure relief system 70B into the first pressure chamber 60 of the fuel injection timing advancing device 55. As a result, since the timer piston 57 also slows down in its advancing rate, the fuel injection pump distributes fuel at a relatively retarded timing between said mostly retarded and the predetermined fuel injection timings as shown by reference characters L–H in FIG. 9. In this case, because the second fuel relief passage 71B with its cross section having a cross sectional area smaller than that of the first fuel relief passage 71A, the retardation of fuel injection timing is smaller in comparing with that when operating under the condition of low elevations, low range of engine loading stated above.

(3) High Elevations, Low Engine Loading;

Under this driving condition, a small quantity of fuel is distributed by the fuel injection pump. In this case, the distance by which the governor sleeve 37 moves is as large as under the the condition of low elevations, low range of engine loading. As a deserved result, because, although a communication is created between the first relief port 72A of the governor sleeve 37 and the first fuel relief passage 71A of the first pressure relief system 70A, the inlet port 78 of the regulating valve 73 is closed by the valve body 75 as is shown in FIG. 8(B), neither the first pressure relief 70A nor the second pressure relief system 70B is enabled and thereby no pressure drop is caused in the pump chamber 5 so as to advance the fuel injection timing of the fuel injection pump to a mostly advanced fuel injection timing as shown by reference characteristics H–L in FIG. 9. In other words, the advancing rate of the fuel injection pump becomes the highest.

(4) High Elevations, High Engine Loading;

Under this driving condition, a large quantity of fuel is delivered by the fuel injection pump. The governor sleeve 37 protrudes as small distance as under the condition of low elevations, high range of engine loading. Therefore, the first relief port 72A is placed out of communication with the first fuel relief passage 71A as is shown in FIG. 7(B) and, on the other hand, the inlet port 78 of the regulating valve 73 is closed by the valve body 75 as shown in FIG. 8(B), rendering the first pressure relief system 70A disabled. However, as apparent from the earlier description, the second relief port 72B of the governor sleeve 37 is brought into communication with the second fuel relief passage 71B, relieving the fuel pressure in the pump chamber 5 through the second pressure relief system 70B. Accordingly, the fuel injection timing of the fuel injection pump is retarded later to the predetermined advanced fuel injection timing which is shown by reference characteristic H-H in FIG. 9. As apparent from the foregoing description concerning the structure and function of the fuel injection timing control apparatus of the first preferred embodiment of the present invention, since the opened area Q of the inlet port 78 of the regulating valve 73 continuously varies according to atmospheric pressure, the fuel injection timing advancing device, as is apparent from FIG. 9, continuously increasingly varies its advancing rate according to altitudes from an advancing rate lower than a predetermined advancing rate under a high range of engine loading to an advancing rate higher than said predetermined rate, when operating in the low range of engine loading. The operations of the first and second pressure relief systems 70A and 70B are summarized in Table 1.

TABLE 1

| | 1st port (72A) | Regulating Valve (73) | Pressure Relief System 1st (70A) | Pressure Relief System 2nd (70B) | Injection Timing |
|---|---|---|---|---|---|
| Low Elevations, Low Loading | A | A | A | X | RETARD |
| Low Elevations, High Loading | X | A | X | B | |
| High Elevations, Low Loading | A | X | X | X | AD-VANCE |
| High Elevations, High Loading | X | X | X | B | |

A: large opened area
B: small opened area
X: closed

Figure 10:
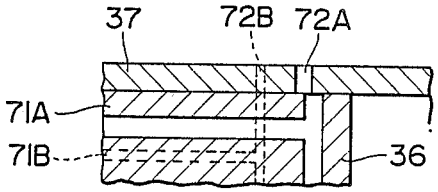
FIG. 10 is a cross sectional view similar to that of FIG. 7(B) and partially illustrating an regulating valve of an alternative preferred embodiment of the present invention.
Figure 11:
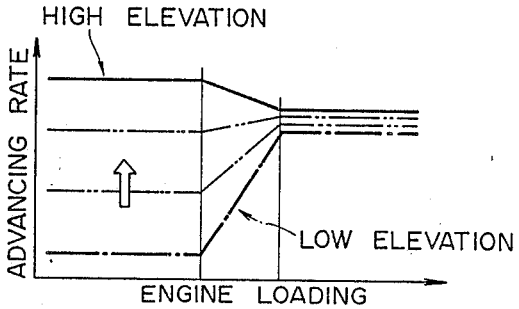
FIG. 11 is a diagram similar to that of FIG. 9 and showing the relationship between advancing rate of fuel injection timing and engine load for several altitudes.

Although, in the fuel injection timing control apparatus of the above described preferred embodiment of the present invention, an advancing rate of fuel injection timing is constant independently of atmospheric pressure in the high range of engine loading and, taking this constant advancing rate for a standard advancing rate, the advance and retardation of fuel injection timing in the low range of engine loading is discussed, nevertheless some variation may be introduced into the advancing rate of fuel injection timing in the high range of engine loading as in an alternative preferred embodiment of the present invention shown in FIG. 10 and 11. In more detail, an advancing rate in a high range of engine loading at high elevations is made a little larger than that in the high range of engine loading at low elevations. For this variation of advancing rate in the high range of engine loading, as is shown in FIG. 10, the first port 72A is brought into partial communication with the first fuel relief passage 71A of the first pressure relief system 70A in the high range of engine loading where the second pressure relief system 70B is fully enabled by bringing the second port 72B into communication with the second fuel relief passage 71B. In other words, the first port 72A is so located on the governor sleeve 37 as to provide a throttled first fuel relief passage 71A when the second fuel relief passage 71B is fully opened. According to the second preferred embodiment of the present invention, due to that the regulating valve 73 places the valve body 75 in the position where the inlet port 78 is opened in the high range of engine loading at low elevations, the first pressure relief system 70A is, though throttled, effective as well as the second pressure relief system 70B. Accordingly, a pressurized fuel may be relieved from the pump chamber 5 in the high load driving range at low elevations slightly more than in the high range of engine loading at high elevations. It is to be noted that the amount of pressurized fuel relieved through the fully opened second pressure relief system 70B and the throttled first pressure relief system 70A is far smaller than that through the fully opened first pressure relief system 70A. In this way, the fuel injection timing control apparatus of this second embodiment of the present invention can advance the fuel injection timing in the high range of engine-loading at high elevations more than at low elevations.

TABLE 2

| | 1st Port (72A) | Regulating Valve (73) | Pressure Relief System 1st (70A) | Pressure Relief System 2nd (70B) | Injection Timing |
|---|---|---|---|---|---|
| Low Elevation Low Loading | A | A | A | X | RETARD |
| Low Elevation High Loading | S | A | S | B | |
| High Elevation Low Loading | A | X | X | X | AD-VANCE |
| High Elevation High Loading | S | X | X | B | |

A: large opened area
B: small opened area
S: half opened
X: closed

Although the present invention has been fully described by way of the preferred embodiments thereof with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A fuel injection apparatus comprising a distributor injection pump for use in a diesel engine, injection timing advancing means for advancing fuel injection timing of said distributor injection pump at an advancing rate according to engine loading, and fuel injection timing control means for controlling said injection timing advancing means, said fuel injection timing control means comprising:

(a) retarding means for, in a low range of engine loading, substantially retarding fuel injection timing by diminishing the advancing rate of said injection timing advancing means lower than a predetermined advancing rate for a high range of engine loading;

(b) varying means for, in said low range of engine loading, continuously varying the advancing rate of said injection timing advancing means between the diminished advancing rate and a mostly advanced rate higher than said predetermined advancing rate of said injection timing advancing means;

(c) pressure sensitive means for forcing said varying means to effect continuous variation of the advancing rate of said injection timing advancing means in accordance with atmospheric pressure;

(d) first advancing rate varying means for, in the high range of engine loading, maintaining the advancing rate of said injection timing advancing means substantially at the predetermined advancing rate, and (e) second advancing rate varying means for, in the range of engine loading between the low and high ranges of engine loading, advancing the advancing rate of said injection timing advancing means responsive to said pressure sensitive means from the diminished advancing rate to the predetermined advancing rate and retarding the advancing rate of said injection timing advancing means responsive to said pressure sensitive means from the mostly advanced rate higher than the predetermined advancing rate to the predetermined advancing rate as engine loading increases.

2. A fuel injection apparatus comprising a distributor injection pump for a diesel engine, said pump having a pump chamber, means defining a high pressure chamber and in communication with the pump chamber, means defining a low pressure chamber, injection timing advancing means with an advancing member disposed between the high pressure chamber in communication with the pump chamber of said distributor injection pump and the low pressure chamber for advancing a fuel injection timing of said distributor injection pump at an advancing rate in accordance with a rise of pressure in said pump chamber of said distributor injection pump, and fuel injection timing control means including:

(a) first and second pressure relief means for relieving pressure in said pump chamber into said low pressure chamber in a low range and a high range of engine loading, respectively, said first pressure relief having a maximum amount of pressure relieved therethrough larger than that of said second pressure relief; and (b) regulating valve means cooperating with said first pressure relief for varying the amount of pressure relieved by said first pressure relief in accordance with atmospheric pressure.

3. Fuel injection apparatus as defined in claim 2, wherein said distributor injection pump includes a governor shaft with a governor sleeve slidably mounted thereon, each said pressure relief includes a fuel relief conduit partly formed in the governor shaft of said distributor injection pump and a relief port formed in the governor sleeve slidably mounted on said governor shaft, said relief port increasingly variably opening said fuel relief conduit to said pump chamber in accordance with engine loading.

4. Fuel injection apparatus as defined in claim 3, wherein said fuel relief conduit has a cross-sectional area larger for said first pressure relief than for said second pressure relief.

5. Fuel injection apparatus as defined in claim 3, wherein said regulating valve means comprises a valve body for opening and closing said first pressure relief with a varying said cross-sectional area of fuel relief and aneroid means for causing said valve body to open and close in accordance with atmospheric pressure.

6. Fuel injection apparatus as defined in claim 5, wherein said aneroid means is in the form of a pressure sensitive sealed bellows.

7. Fuel injection apparatus comprising a distributor injection pump for use in diesel engine having a pump chamber, means defining a high pressure chamber in communication with the pump chamber, means defining a low pressure chamber, injection timing advancing means with an advancing member disposed between the high pressure chamber in communication with the pump chamber of said distributor injection pump and the low pressure chamber for advancing a fuel injection timing of said distribution injection pump at an advancing rate in accordance with a rise of fuel pressure in said pump chamber of said distributor injection pump, and fuel injection timing control means including:

(a) first and second pressure relief means for relieving pressure in said pump chamber into said low pressure chamber, said first pressure relief being actuated fully in a low range of engine loading and partly in a high range of engine loading, and said second pressure relief being actuated fully in said high range of engine loading; and (b) regulating valve means cooperating with said first pressure relief for varying the amount of pressure relieved in accordance with atmospheric pressure.

8. Fuel injection apparatus as defined in claim 7, wherein said pump includes a governor shaft with a governor sleeve slidably mounted thereon and each said pressure relief includes a fuel relief conduit partly formed in the governor shaft of said distributor injection pump and a relief port formed in the governor sleeve slidably mounted on said governor shaft, said relief port variably opening said fuel relief conduit in accordance with engine loading.

9. Fuel injection apparatus as defined in claim 8, wherein said fuel relief conduit has a cross-sectional area larger for said first pressure relief than for said second pressure relief.

10. Fuel injection apparatus as defined in claim 9, wherein a total opened area of said first and second pressure relief is larger in said low range of engine loading than in said high range of engine loading.

11. Fuel injection apparatus as defined in claim 7, wherein said regulating valve means comprises a valve body for opening and closing said first pressure relief so as to vary its cross-sectional area and aneroid means for causing said valve body to open and close in accordance with atmospheric pressure.

12. Fuel injection apparatus as defined in claim 11, wherein said aneroid means is in the form of a pressure sensitive sealed bellows.

13. Fuel injection apparatus according to claim 1 wherein said predetermined advancing rate is a range of advancing rates.

14. Fuel injection apparatus according to claim 13 wherein said third advancing rate varying means advances the advancing rate from the diminished advancing rate to the lowest advancing rate of the range of predetermined advancing rates and retards the advancing rate from the mostly advanced rate to the highest advancing rate of the range of predetermined advancing rates.

* * * * *